US007845385B2

(12) United States Patent
Goodman et al.

(10) Patent No.: US 7,845,385 B2
(45) **Date of Patent: *Dec. 7, 2010**

(54) STEERABLE TROLLIES FOR MOVABLE PARTITIONS, PARTITION SYSTEMS INCLUDING STEERABLE TROLLEYS, AND METHODS OF CLOSING PARTITIONS

(75) Inventors: E. Carl Goodman, Bountiful, UT (US); Kevin D. Banta, Highland, UT (US); D. George Field, Pleasant Grove, UT (US); William Michael Coleman, Salt Lake City, UT (US)

(73) Assignee: Won-Door Corporation, Salt Lake City, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/356,126

(22) Filed: Jan. 20, 2009

(65) Prior Publication Data

US 2009/0120595 A1 May 14, 2009

Related U.S. Application Data

(60) Continuation of application No. 11/857,203, filed on Sep. 18, 2007, now Pat. No. 7,513,293, which is a division of application No. 11/097,101, filed on Apr. 1, 2005, now Pat. No. 7,478,663.

(60) Provisional application No. 60/558,944, filed on Apr. 2, 2004.

(51) Int. Cl.
*E05F 15/00* (2006.01)

(52) U.S. Cl. ..... 160/188; 160/199

(58) Field of Classification Search ..... 160/1, 160/188, 196.1, 199, 201, 84.02, 84.08; 180/434–438; 105/163.2
See application file for complete search history.

(56) References Cited

U.S. PATENT DOCUMENTS 3,223,147 A 12/1965 Holloway (Continued)

FOREIGN PATENT DOCUMENTS

DE 877664 5/1953

(Continued)

OTHER PUBLICATIONS

International Search Report for PCT Application PCT/US2005/011374, dated Aug. 5, 2005 (4 pages).

*Primary Examiner*—Blair M. Johnson
(74) *Attorney, Agent, or Firm*—TraskBritt

(57) ABSTRACT

An apparatus and method of directionally controlling a movable partition includes providing at least one roller assembly and a steering actuator, coupled therewith, to a portion of the partition. A controller may be used to control the steering actuator and thereby select, or change, the orientation of the roller assembly with respect to the partition. In one embodiment, one or more sensors may be used to determine the vertical orientation of the partition including whether the partition, or a section thereof, is substantially plumb. If the partition is substantially out of plumb, for example, if a lower edge of the partition is laterally displaced relative to an upper edge of the partition, the controller and steering actuator may cause the at least one roller assembly to direct the partition, or section thereof, in a particular direction until the partition, or section thereof, becomes substantially plumb.

12 Claims, 15 Drawing Sheets

U.S. PATENT DOCUMENTS

| | | | | |
|---|---|---|---|---|
| 3,453,790 | A | 7/1969 | Harris | |
| 3,799,237 | A | 3/1974 | Proserpi | |
| 3,850,223 | A | 11/1974 | Tompkins | |
| 3,972,381 | A | 8/1976 | Gail | |
| 4,034,524 | A | 7/1977 | Fromme et al. | |
| 4,408,369 | A | 10/1983 | Labelle | |
| 4,763,712 | A | 8/1988 | van der Klaauw | |
| 5,016,318 | A | 5/1991 | Harris | |
| 5,332,992 | A | 7/1994 | Woods | |
| 5,530,428 | A | 6/1996 | Woods | |
| 5,673,021 | A | 9/1997 | Woods | |
| 5,880,659 | A | 3/1999 | Woods | |
| 5,977,873 | A | 11/1999 | Woods | |
| 6,360,518 | B1 | 3/2002 | Scott et al. | |
| 6,662,848 | B2 | 12/2003 | Goodman et al. | |
| 7,478,663 | B2 * | 1/2009 | Goodman et al. | 160/188 |
| 7,513,293 | B2 * | 4/2009 | Goodman et al. | 160/188 |
| 2004/0069420 | A1 | 4/2004 | Petriello | |
| 2009/0120595 | A1 * | 5/2009 | Goodman et al. | 160/371 |

FOREIGN PATENT DOCUMENTS

| | | |
|---|---|---|
| EP | 0750929 | 1/1997 |
| WO | 9608959 | 3/1996 |

* cited by examiner

STEERABLE TROLLIES FOR MOVABLE PARTITIONS, PARTITION SYSTEMS INCLUDING STEERABLE TROLLEYS, AND METHODS OF CLOSING PARTITIONS

CROSS-REFERENCE TO RELATED APPLICATIONS

This application is a continuation of application Ser. No. 11/857,203, filed Sep. 18, 2007, now U.S. Pat. No. 7,513,293, issued Apr. 7, 2009, which is a divisional of application Ser. No. 11/097,101, filed Apr. 1, 2005, now U.S. Pat. 7,478,663, on Jan. 20, 2009, which claims the benefit of U.S. Provisional Patent Application Ser. No. 60/558,944, filed Apr. 2, 2004 for METHOD, APPARATUS AND SYSTEM FOR DIRECTIONALLY CONTROLLING A MOVABLE PARTITION, the disclosures of each of which are incorporated by reference herein in their entireties.

BACKGROUND OF THE INVENTION

1. Field of the Invention

The present invention generally relates to the control of movable partitions and, more particularly, to the directional control of such partitions including, for example, foldable doors.

2. State of the Art

Movable partitions are utilized in numerous situations and environments for a variety of purposes. Such partitions may include, for example, foldable or collapsible doors configured to enclose or subdivide a room or other area. Often such partitions may be utilized simply for purposes of versatility in being able to subdivide a single large room into multiple smaller rooms. The subdivision of a larger area may be desired, for example, to accommodate multiple groups or meetings simultaneously. In other applications, such partitions may be utilized for noise control depending, for example, on the activities taking place in a given room or portion thereof.

Movable partitions may also be used to provide a security and/or fire barrier. In such a case, the door may be configured to automatically close upon the occurrence of a predetermined event such as the actuation of an associated alarm. For example, one or more accordion or similar folding-type doors may be used as a security and/or a fire door wherein each door is formed with a plurality of panels hingedly connected to one another. The hinged connection of the panels allows the door to fold up in a compact unit for purposes of storage when not deployed. Thus, the door may be stored, for example, in a pocket formed in the wall of a building when in a retracted or folded state. When deployment of the door is required to secure an area during a fire or for any other specified reason, the door is driven by a motor along a track, conventionally located above the door in a header, until the door is extended a desired distance across the room to form an appropriate barrier.

When deployed, a leading edge of the door, often defined by a component known as a lead post, complementarily engages a receptacle in a fixed structure, such as a wall, or in a mating receptacle of another door. Such a receptacle may be referred to as a jamb or a door post when formed in a fixed structure, or as a mating lead post when formed in another door. It is desirable that the lead post be substantially aligned with the mating receptacle such that the door may be completely closed and an appropriate seal formed between the door and mating receptacle. For example, if the door is being used as a fire door, it is desirable that the lead post of a door is fully engaged with the mating receptacle to prevent drafts and any attendant flames or smoke from traversing the barrier formed by the partition and, more particularly, the joint formed by the lead post and receptacle.

In some cases, the lower edge of the door, including the lower edge of the door's lead post, may be laterally displaced relative to the top edge of the door, which is relatively fixed in a lateral sense due to its engagement with the track and header. Such lateral displacement of the door's lower edge may be caused, for example, by a fire-induced draft, by an improperly balanced HVAC system, or simply from an occupant of a room pushing against the door while it is being deployed. If the lower edge of the lead post is laterally displaced relative to its upper edge as the leading edge of the door approaches the mating receptacle, the lead post will not be properly aligned with the mating receptacle and an appropriate seal will not be formed. In other words, the mating receptacle is conventionally installed to be substantially plumb. If the lower edge of a lead post of a door is laterally displaced relative to its upper edge, the lead post is not plumb (or substantially vertically oriented) and thus will not properly engage the substantially plumb receptacle.

As noted above, the failure of the lead post to properly engage the receptacle may have substantial consequences when, for example, the door is being used as a fire or security barrier. At a minimum, even when the door is not used as a fire or security barrier, the failure of the lead post to properly engage the mating receptacle will result in the inability to completely subdivide a larger room and visually or acoustically isolate the subdivided room.

One approach to preventing or controlling the lateral displacement of a lower edge of the door has included forming a guide track within the floor of a room and then causing the door or barrier to engage the track as it is deployed and retracted such that the door is laterally constrained relative to the path of the track. However, the placement of a track in the floor of a room is not an ideal solution for all environments. For example, such a track provides a place for collection of dust and debris and may, thereby, become an unsightly feature of the room. In some cases, the collection of debris may affect the proper operation of the door itself. Furthermore, the existence of a track in the floor may act as a hazard or potential source of injury depending, for example, on the intended use of the area and the actual location of the floor track within that area.

In view of the current state of the art, it would be advantageous to provide a method, apparatus and system for directionally controlling movable barriers including, for example, extendable and retractable partitions. In directionally controlling such a barrier, it would be advantageous to enable automatic control of the door with respect to any lateral displacement of the lower edge of the barrier with respect to the upper edge of the barrier without requiring the installation of an additional track in the floor.

BRIEF SUMMARY OF THE INVENTION

In accordance with one aspect of the invention, an apparatus for directionally controlling a movable partition is provided. The apparatus includes a frame member configured to be coupled to a portion of the movable partition. At least one roller assembly is coupled with the frame member and includes at least one roller element. A steering actuator is operatively coupled with the at least one roller assembly and is configured to alter the orientation of the at least one roller assembly relative to the frame member. In one embodiment, one or more sensors that are located and configured to determine the vertical orientation of at least a section of the movable partition may be associated with the apparatus. The sensor (or sensors) may generate a signal representative of the vertical orientation of at least a portion of the movable partition and transmit the signal to a controller. The controller may then control the steering actuator to alter, if appropriate, the orientation of the at least one roller assembly relative to the frame member to bring the at least a portion of the movable partition back to a substantially vertical orientation. In another embodiment, the apparatus may be used for steering the partition along a specified pathway.

In accordance with another aspect of the present invention, an automatic door is provided. The automatic door includes at least one partition, a drive configured to motivate the partition along a defined pathway, and a directional control apparatus coupled to a lower edge of the at least one partition. The directional control apparatus includes at least one roller assembly coupled to the at least one partition. A steering actuator is operatively coupled with the at least one roller assembly and configured to alter the orientation of the at least one roller assembly relative to the at least one partition. Additionally, one or more sensors that are located and configured to determine the vertical orientation of at least a section of the at least one partition may be associated with the directional control device. The sensor (or sensors) may generate a signal representative of the vertical orientation of the at least a section of the at least one partition and transmit the signal to a controller. The controller may then control the steering actuator to alter, if appropriate, the orientation of the at least one roller assembly relative to the at least one partition to bring the at least a section of the at least one partition back to a substantially vertical orientation.

In accordance with another aspect of the present invention, a system may be provided that includes the apparatus for directionally controlling a movable partition. The system may include one or more movable partitions and may include a controller operatively coupled with the apparatus.

In accordance with yet another aspect of the present invention, a method of controlling a movable partition is provided. The method includes sensing a current orientation of at least a section of the movable partition and, upon sensing that the current orientation of the at least a section of the movable partition is substantially deviated from a desired orientation of the at least a section, displacing at least a portion of the at least a section of the movable partition until the at least a section of the movable partition is substantially at the desired orientation. In one embodiment the desired orientation may be a substantially plumb orientation. As used herein, the term "substantially out of plumb" means out of plumb by an unacceptable magnitude. The method may further include determining whether the movable partition is moving forward or in reverse along a defined pathway. Additionally, the method may include determining whether the defined pathway includes a curved portion.

In accordance with another method of the present invention, another method of controlling a movable partition is provided. The method includes guiding a first edge of the movable partition along a defined pathway which includes at least one curved portion. At least one roller assembly is coupled to a section of the movable partition adjacent a second edge thereof. The direction of movement of the movable partition along the defined pathway is determined and a relative location of the section of the movable partition along the defined pathway is also determined. The at least one roller assembly is selectively steered as the section of the movable partition traverses through the at least one curved portion of the defined pathway.

BRIEF DESCRIPTION OF THE SEVERAL VIEWS OF THE DRAWINGS

The foregoing and other advantages of the invention will become apparent upon reading the following detailed description and upon reference to the drawings in which.

DETAILED DESCRIPTION OF THE INVENTION

Figure 1A:
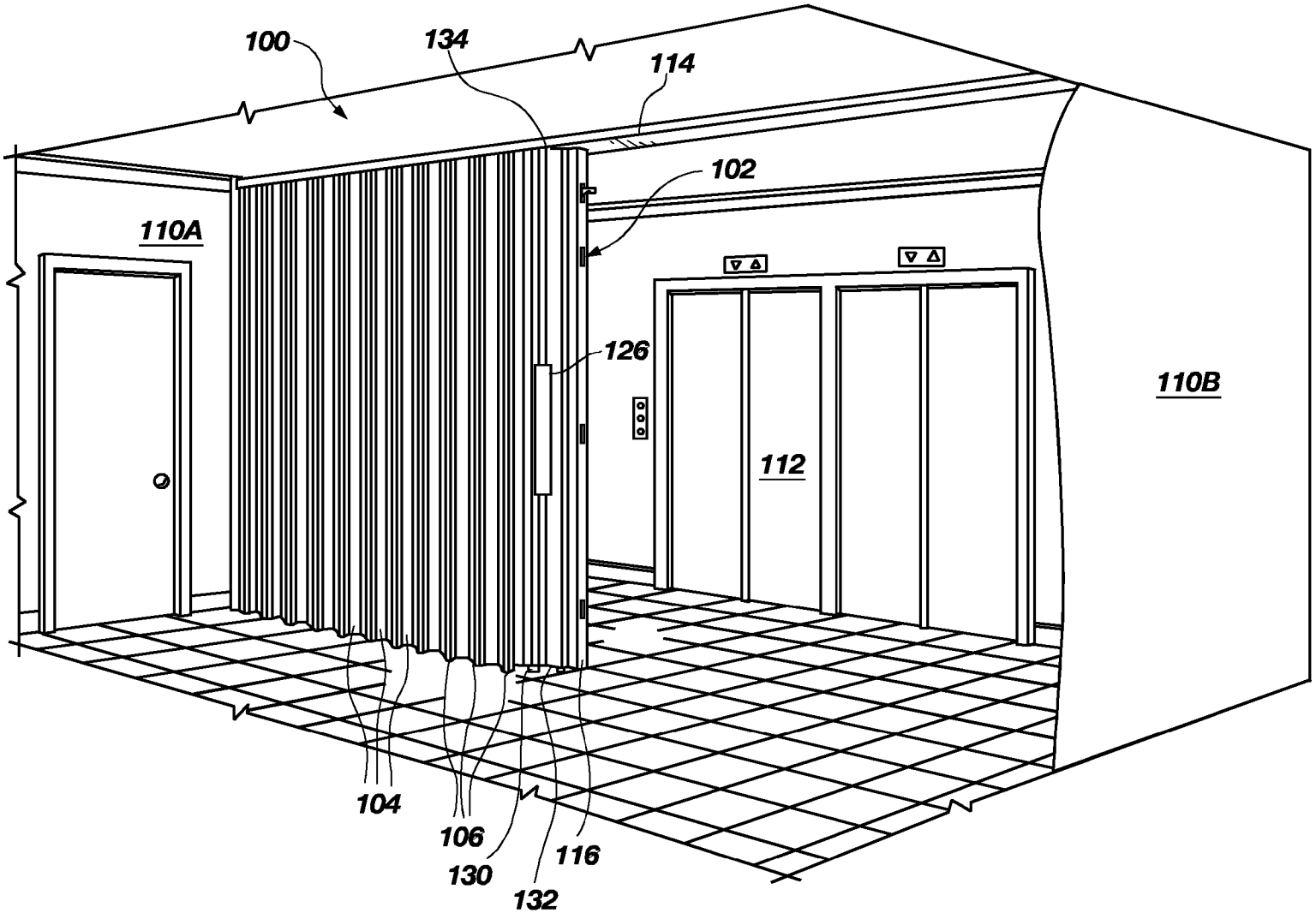
FIGS. 1A-1C show a perspective view, a plan view and an elevational view, respectively, of a system with a movable partition in accordance with an embodiment of the present invention.
Figure 1B:
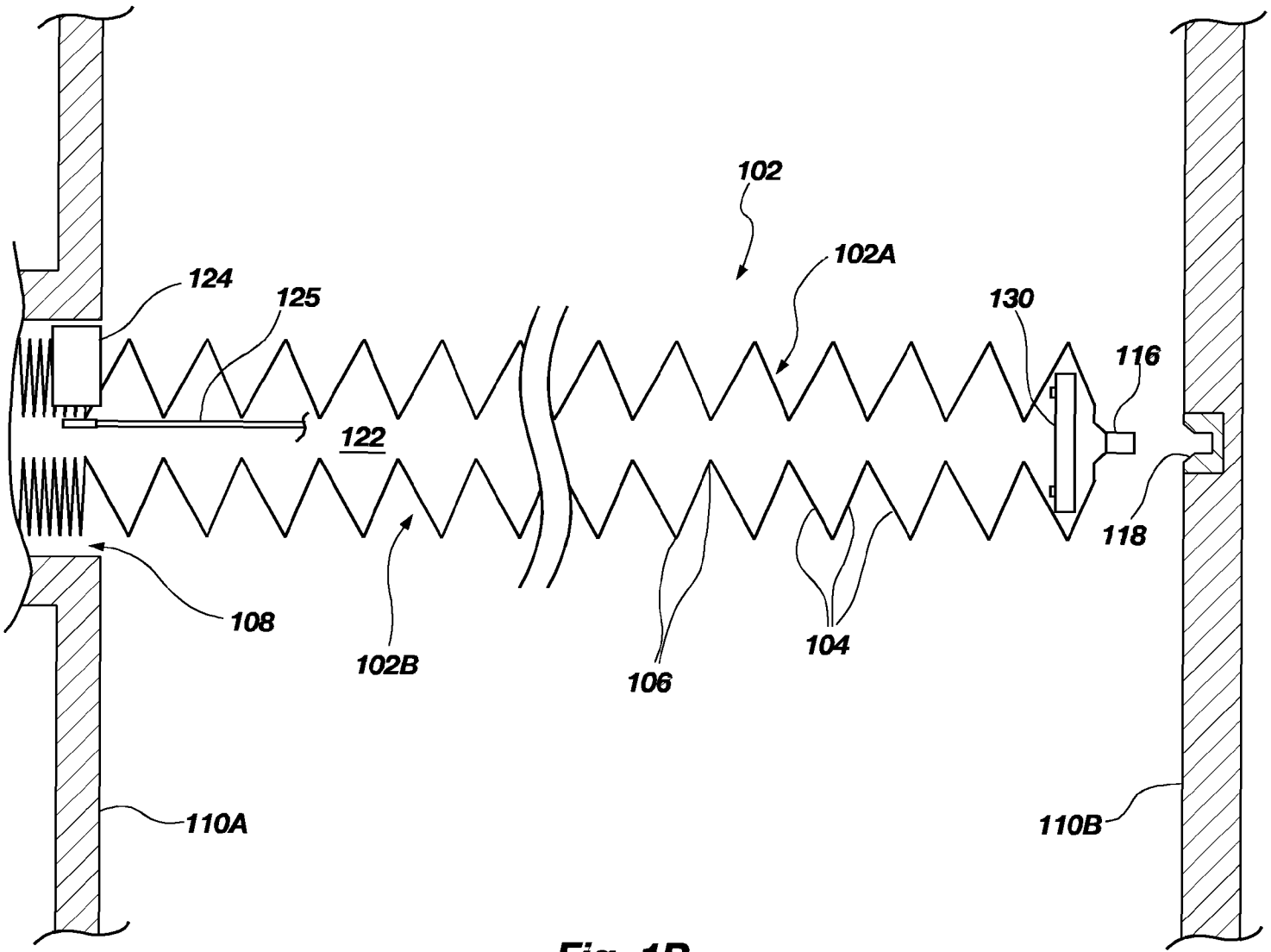
Figure 1C:
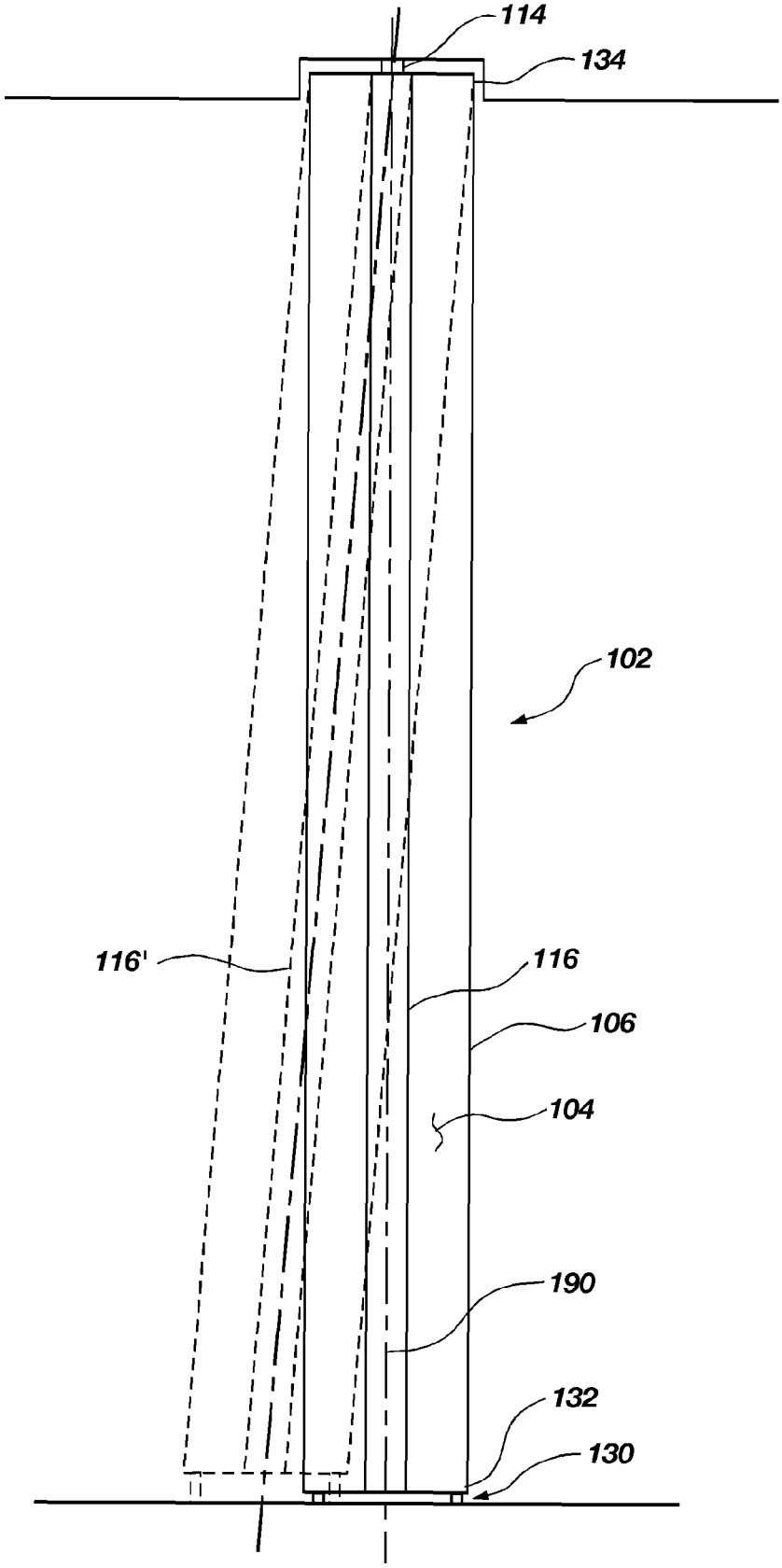

Referring to FIGS. 1A-1C, a system 100 is shown, which may also be referred to as an automatic door system, including a movable partition in the form of an accordion-type door 102. The door 102 may be used, for example, as a security and/or fire door. In other embodiments, the door 102 need not be utilized as a fire or security door, but may be used simply for the subdividing of a larger space into smaller rooms or areas. The door 102 may be formed with a plurality of panels 104 that are connected to one another with hinges or other hinge-like members 106. The hinged connection of the panels 104 allows the door 102 to be compactly stored in a pocket 108 formed in a wall 110A of a building when in a retracted or folded state.

When it is desired to deploy the door 102 to an extended position, for example, to secure an area such as an elevator lobby 112 during a fire, the door 102 is driven along a track 114 across the space to provide an appropriate barrier. When in a deployed or an extended state, a leading edge of the door 102, shown as a male lead post 116, complementarily or matingly engages with a jamb or door post 118 that may be formed in a wall 110B of a building. As can be seen in FIG. 1B, an accordion-type door 102 may include a first accordion-style partition 102A and a second accordion-style partition 102B which is laterally spaced from the first partition 102A. Such a configuration may be utilized as a fire door wherein one partition 102A acts as a primary fire and smoke barrier, the space 122 between the two partitions 102A and 102B acts as an insulator or a buffer zone, and the second partition 102B acts as a secondary fire and smoke barrier. Such a configuration may also be useful in providing an acoustical barrier when the door 102 is used to subdivide a larger space into multiple, smaller rooms.

A drive, which may include, for example, a motor 124 and a drive belt or chain 125 (FIG. 1B), may be configured to open and close the door 102 upon actuation thereof. The automatic door system 100 may further include various sensors and switches to assist in the control of the door 102 through appropriate connection with the drive. For example, as shown in FIG. 1A, when used as a fire door, the door 102 may include a switch or actuator 126, commonly referred to as "panic hardware." Actuation of the panic hardware 126 allows a person located on one side of the door 102 to cause the door to open if it is closed, or to stop while it is closing, allowing access through the barrier formed by the door for a predetermined amount of time.

It is noted that, while the exemplary embodiment shown and described with respect to FIGS. 1A and 1B is directed to a single accordion-type door 102, other movable partitions may be utilized. For example, a two-door, or bi-part door, system may be utilized wherein two similarly configured doors extend across a space and join together to form an appropriate barrier. Also, the present invention is applicable to movable partitions or barriers other than the accordion-type doors that are shown and described herein in an exemplary embodiment.

Referring still to FIGS. 1A-1C, the door 102 of the present invention further includes a directional control apparatus 130 that may be used to ensure vertical alignment of the door 102 or at least a portion thereof. For example, upon the exertion of an external force, such as by a draft or from an individual pushing on the door 102 while it is being deployed or retracted, the lead post 116 (or some other section of the door 102) may deviate from its intended plumb, or substantially vertical, orientation as indicated by dashed lines at 116' in FIG. 1C. In other words, a lower portion of the door 102, such as the lower edge 132, may become laterally displaced relative to the upper edge 134 of the door 102, which is substantially laterally fixed by virtue of its engagement with the track 114. As previously discussed, in such a case where the lead post 116 is out of plumb (e.g., not substantially vertically oriented), the lead post 116 will not properly engage the jamb or door post 118 and will prevent the door 102 from properly closing and forming a proper barrier. However, in accordance with the present invention, the directional control apparatus 130 may be configured to correct a deviation of the door from its desired course or orientation.

It is noted that, while the present invention is generally discussed with respect to detecting that a section of a door 102 or other partition has deviated from a substantially plumb or vertical orientation and then correcting that deviation through use of a directional control apparatus 130, the present invention more broadly contemplates determining the current or actual orientation of a section of the door 102 relative to a reference orientation (e.g., a reference axis or reference plane) and actively positioning the section of the door to a selected or specified orientation relative to the reference orientation.

For example, an existing or previously installed door 102 may be retrofitted or modified to include a directional control apparatus 130. In certain installations, the door post 118, with which a lead post 116 will engage, may have been improperly or carelessly installed such that it is out of plumb by a determined magnitude. In such a case, the directional control apparatus 130 may be configured to steer the lead post 116 of the door 102 such that it is also out of plumb by the same magnitude, and in a corresponding direction, thereby enabling the lead post 116 to engage with the door post 118 and effect a desired coupling or seal therebetween. In short, the present invention may include detecting the actual orientation of a section of the door 102 relative to plumb (or any other specified reference orientation) and, if necessary, reposition the section of the door 102 so that it is at a specified orientation relative to the reference orientation (e.g., plumb).

Figure 2A:
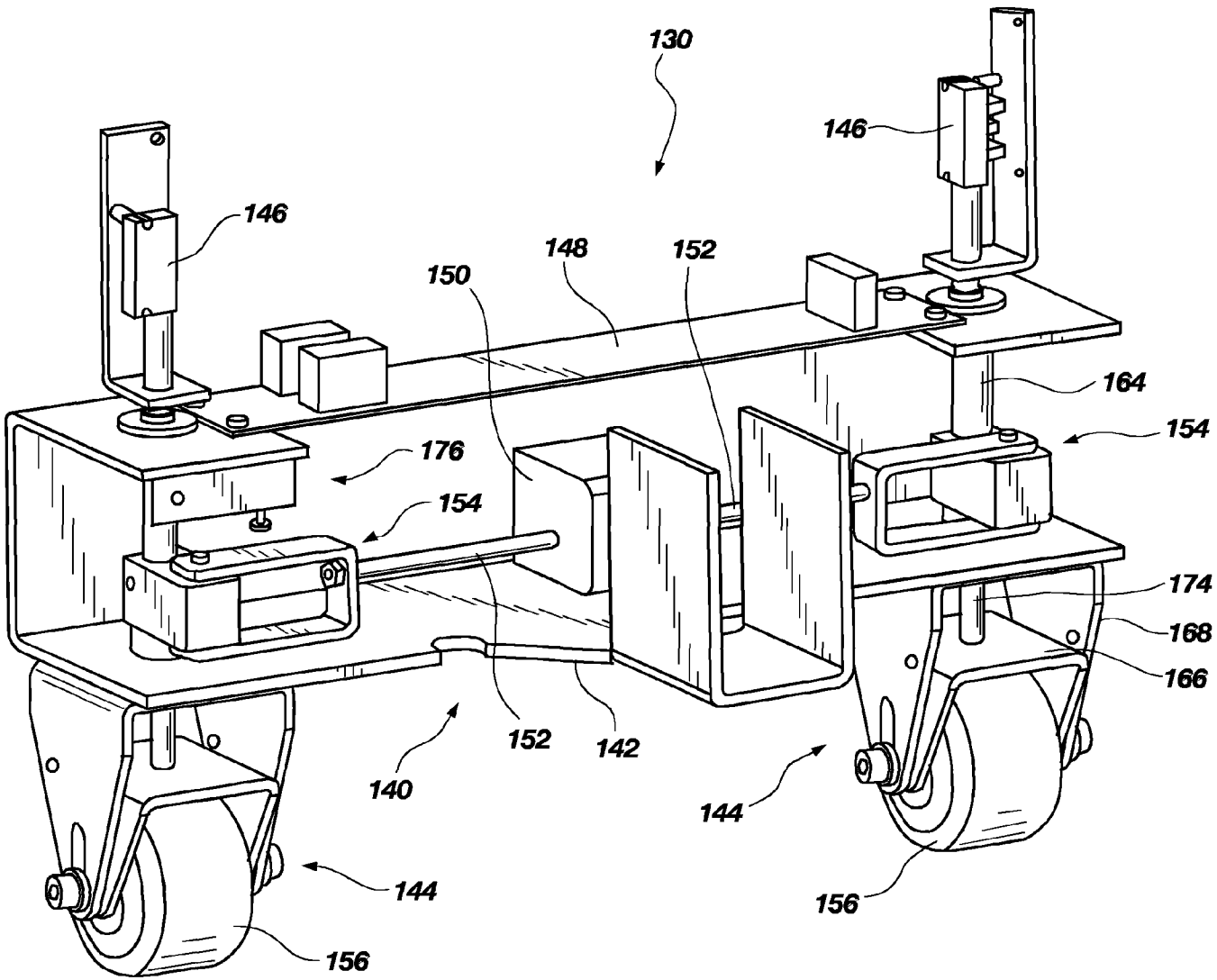
FIGS. 2A and 2B show perspective views of an apparatus for directionally controlling a movable partition in accordance with an embodiment of the present invention.
Figure 2B:
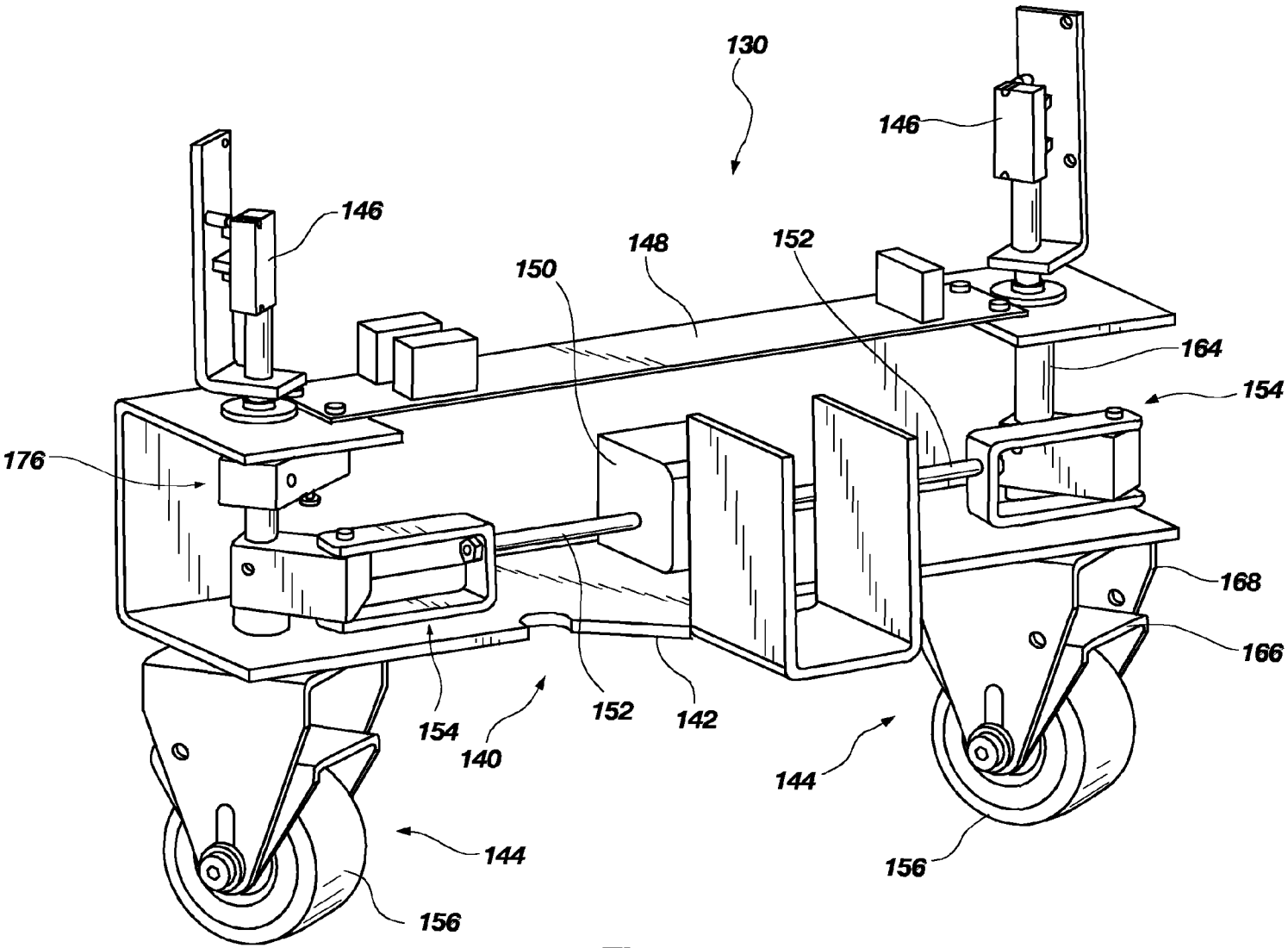

Referring now to FIGS. 2A and 2B, an exemplary directional control apparatus 130 includes a trolley 140 comprising a frame member 142 and one or more steerable roller assemblies 144 coupled therewith. The frame member 142 may also be configured to be coupled with a section of the door 102 (FIGS. 1A-1C), such as, for example, adjacent the lead post 116. One or more sensors 146 may be used to determine whether the door 102 (FIGS. 1A-1C), or at least the section in which the directional control apparatus 130 is disposed, is out of plumb. The sensors 146 may be operatively coupled to and in communication with a control module 148 that provides instructions to and controls a steering actuator 150. The steering actuator 150 may be mechanically coupled with the roller assemblies 144 through linkage components including, for example, drive rods 152 and pivot assemblies 154. In another embodiment, the steering actuator 150 may be more directly coupled to a roller assembly 144 such as through appropriate gearing or other appropriate mechanical couplings. The steering actuator 150 may include, for example, a linear positioning stepper motor configured to displace the drive rods 152 in a substantially linear direction. Of course, other actuators and drive assemblies may be utilized as will be appreciated by those of ordinary skill in the art.

Figure 3:
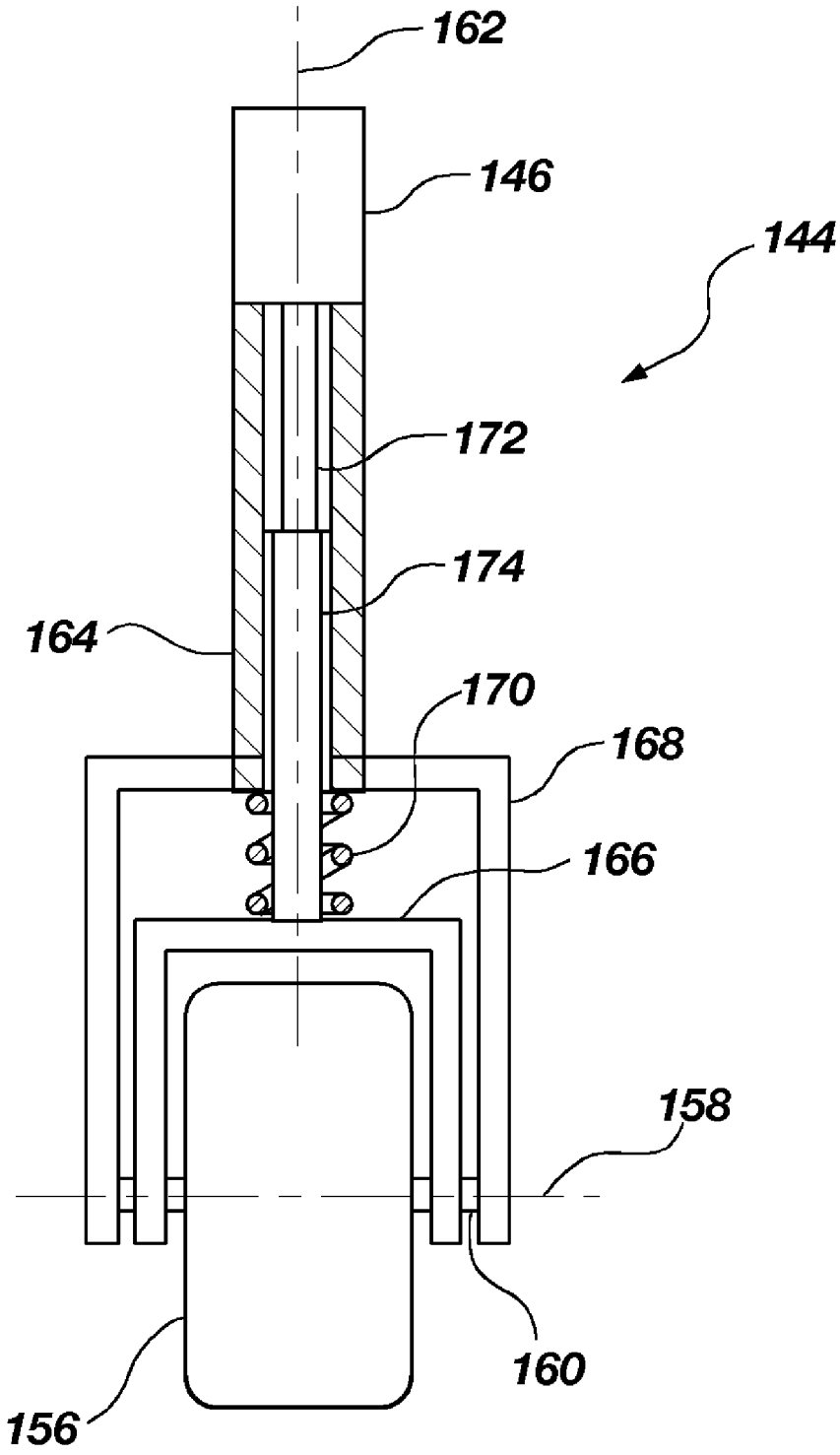
FIG. 3 shows a partial cross-sectional view of a roller assembly used in conjunction with the apparatus shown in FIGS. 2A and 2B in accordance with an embodiment of the present invention.

Referring briefly to FIG. 3 in conjunction with FIGS. 2A and 2B, a roller assembly 144 is shown in partial cross-sectional view in accordance with one embodiment of the present invention. Each roller assembly 144 may include a rolling member, such as a wheel 156, configured to rotate or roll about a first axis 158, referred to herein as a rolling axis, and which may be defined by a shaft 160. The roller assembly 144 is further configured to rotate or be steered about a second axis 162, referred to herein as a steering axis, and which may be defined by a steering shaft 164. Inner and outer support members 166 and 168 may be used to support the wheel 156 in relationship to the frame member 142 while enabling a portion of the roller assembly 144, including the wheel 156, to be displaced in a direction generally along the steering axis 162 relative to the frame member 142. A biasing member 170, such as a spring, may be disposed between the inner and outer support members 166 and 168 to bias the wheel 156 away from the frame member 142 so as to ensure that the wheel 156 maintains contact with the floor or other surface.

As also shown in FIG. 3, one or more sensors 146 may be coupled to the roller assembly 144 in determining whether a door 102 (FIGS. 1A-1C) is in plumb or out of plumb. For example, the sensor 146 may include a linear potentiometer having a component 172 that engages an inner shaft 174 (also referred to herein as the inner steering shaft) coupled to the inner support member 166. As the wheel 156 and inner support member 166 are displaced along the steering axis 162 relative to the frame member 142 (FIGS. 2A and 2B) and the outer support member 168, such relative displacement is detected by the linear potentiometer. The linear potentiometer then produces a voltage signal that is representative of both the magnitude and the direction of such relative displacement. It is noted that other types of sensors may be utilized to help determine whether a door 102 is in plumb or out of plumb and, if out of plumb, the magnitude of deviation from an in-plumb state. For example, the sensor 146 may include an optical or magnetic encoder, a tilt sensor or switch, a linear variable differential transformer, a laser switch, a Hall effect transducer or an ultrasonic transducer.

Referring back to FIGS. 2A and 2B, the directional control apparatus 130 may further include an alignment assembly 176 associated with a roller assembly 144 and configured to automatically align the roller assembly 144 when the directional control apparatus 130 is initiated or at other desired times. For example, referring to FIGS. 4A and 4B, an exemplary alignment assembly 176 may include one or more sensors 178A and 178B, such as proximity sensors, and an alignment indicator 180 that is coupled to the steering shaft 164. The sensors 178A and 178B may thus determine when the alignment indicator 180 is at a predetermined location representing a desired orientation of the roller assembly 144. In one embodiment, the sensors 178A and 178B may include a magnetic-type proximity sensor configured to detect the presence of a ferromagnetic object. In such an embodiment, the alignment indicator 180 may be formed of a ferromagnetic material and configured to define slots 182A and 182B. The sensors 178A and 178B are then disposed so as to be locationally above the radial pathway of an associated slot 182A and 182B. As the alignment indicator 180 rotates with the steering shaft 164 of the roller assembly 144, the sensors 178A and 178B detect the presence or absence of any ferromagnetic material. Thus, if the alignment indicator 180 is positioned such that the sensors 178A and 178B are immediately adjacent the slots 182A and 182B, such as shown in FIG. 4B, the sensors 178A and 178B will appropriately indicate the lack of ferromagnetic material. However, if the alignment indicator 180 is oriented such that one of the sensors 178A is positioned above and adjacent a portion of the ferromagnetic material of the alignment indicator 180, such as is shown in FIG. 4C, the sensor 178A will indicate the presence of such ferromagnetic material.

Figure 4A:
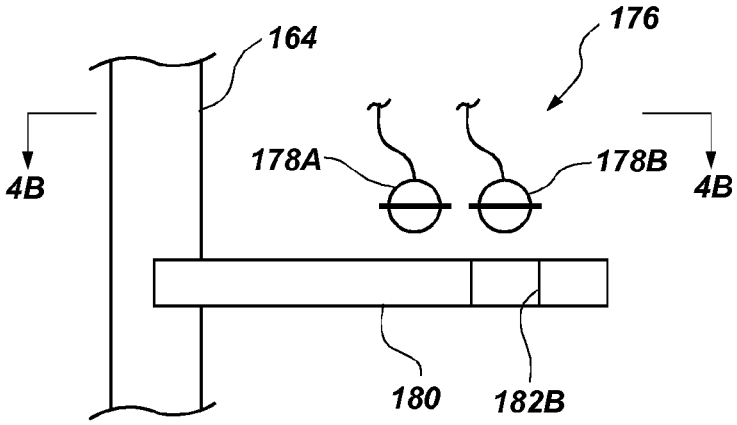
FIGS. 4A-4C show an alignment apparatus used in conjunction with the apparatus shown in FIGS. 2A and 2B according to an embodiment of the present invention.
Figure 4B:
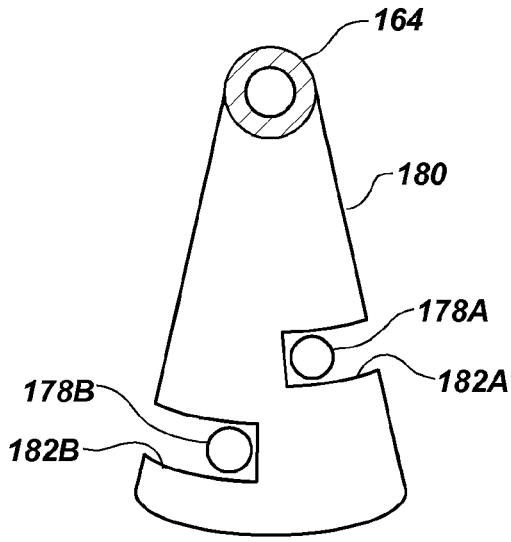
Figure 4C:
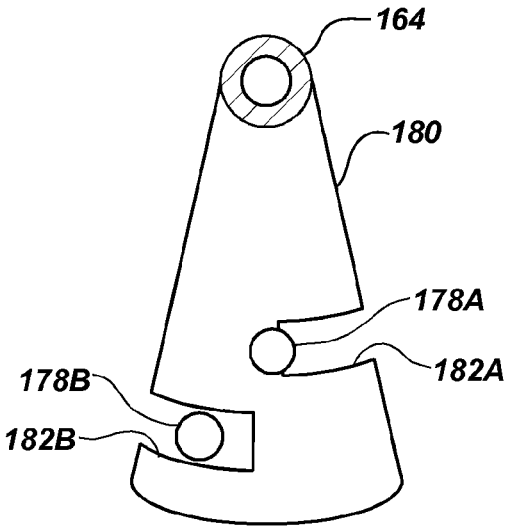

In aligning the roller assemblies 144 using the embodiment shown and described with respect to FIGS. 4A-4C, if one of the sensors 178A detects the presence of a ferromagnetic material (such as shown in FIG. 4C), an appropriate signal will be sent to the control module 148 (FIGS. 2A and 2B) to actuate the steering actuator 150 to effect rotation of the roller assembly 144 about the steering axis 162 in a desired direction. Similarly, if the other sensor 178B indicates the detection of a ferromagnetic material, the control module 148 and steering actuator 150 will effect rotation of the roller assembly 144 in the opposite direction. When both sensors 178A and 178B indicate a lack of presence of ferromagnetic material (such as shown in FIGS. 4A and 4B), the control module 148 will recognize that the roller assembly 144 is appropriately aligned.

In one embodiment, the sensors 178A and 178B may include a MAGNASPHERE® ferrous proximity switch available from Magnasphere Corporation of Brookfield, Wis. The alignment indicator may be formed of a material comprising steel or another ferrous metal or metal alloy. Of course, it will be appreciated by those of ordinary skill in the art that other components may be used for the sensors 178A and 178B and/or alignment indicator 180 in practicing the described embodiment. Additionally, other alignment assemblies or mechanisms may be used for initial and/or periodic alignment of the roller assemblies 144.

Figure 5A:
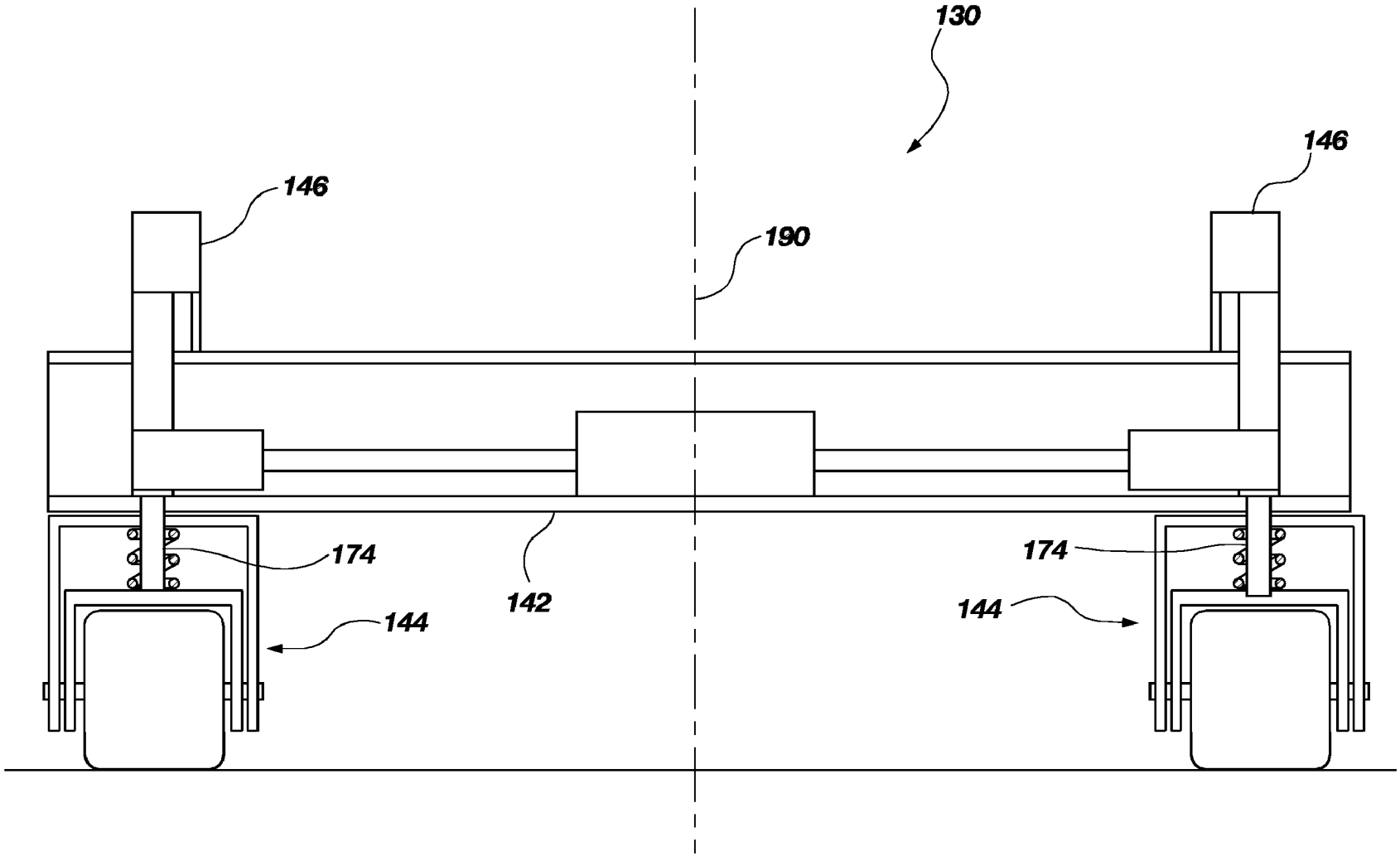
FIGS. 5A and 5B show elevational views of the apparatus of FIGS. 2A and 2B at various stages of operation in accordance with an embodiment of the present invention.

Referring to FIGS. 1A-1C, 2A, 2B, 3, 5A and 5B, operation of the directional control apparatus 130 is now described. As indicated above, upon initialization or powering up of the directional control apparatus 130, the roller assemblies 144 are aligned to a predetermined orientation relative to the frame member 142. As the door 102 is being deployed, roller assemblies 144 maintain their initial orientation until the door 102 is sensed to be out of plumb. In one embodiment, the door 102, or a portion thereof, is determined to be out of plumb by monitoring the displacement of the inner steering shafts 174 relative to the frame member 142 using linear potentiometers as sensors 146. Thus, if the door 102 or, more particularly, the section of the door 102 being monitored such as the lead post 116, is substantially plumb as indicated in FIG. 5A, the linear potentiometers (sensors 146) may generate voltage signals which are similar to one another. For example, in one embodiment, if the section of the door 102 located above the directional control apparatus 130 is plumb, each sensor 146 will generate a signal of approximately 2.5 volts.

Figure 5B:
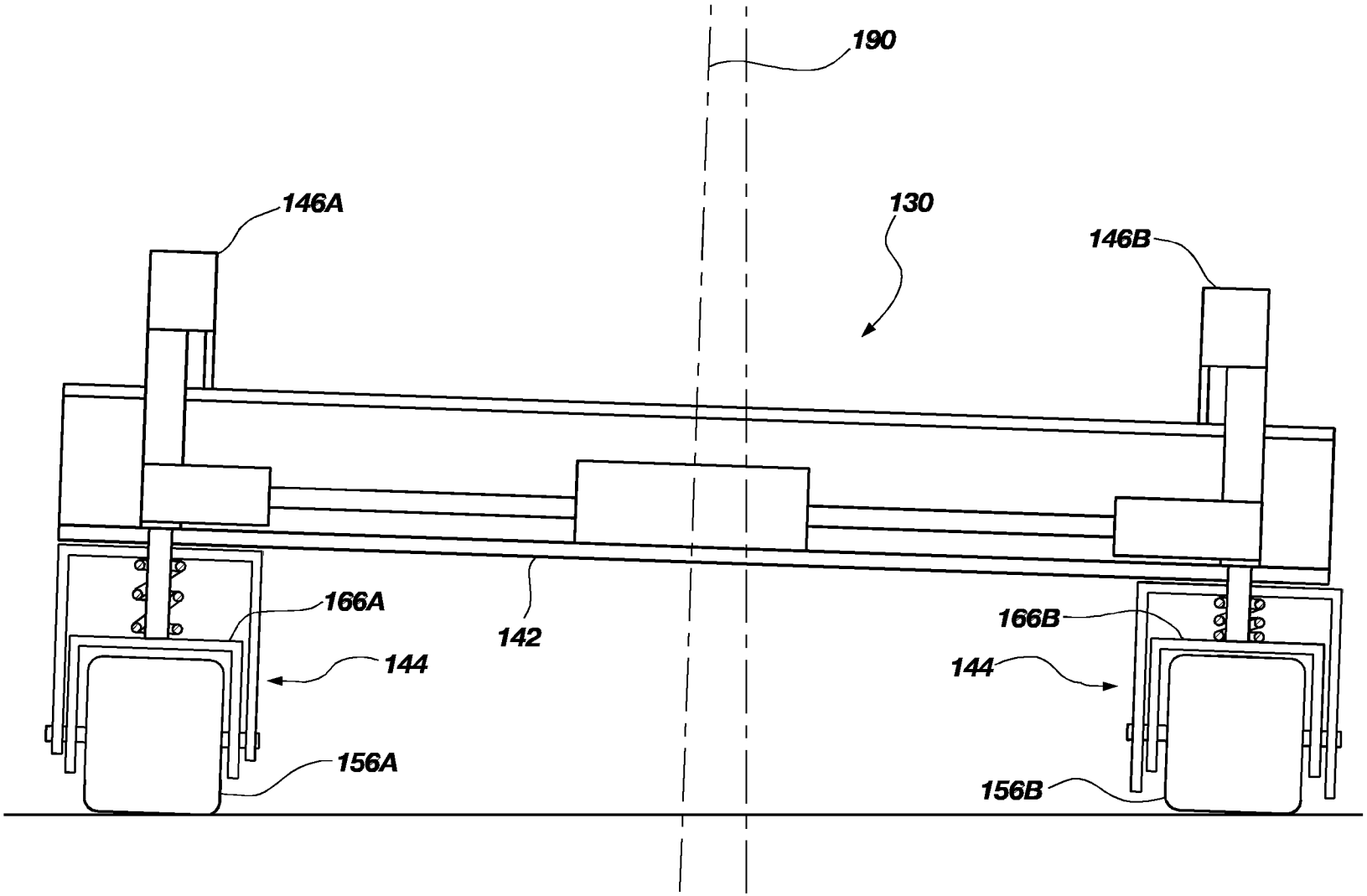

If the section of the door 102 positioned above the directional control apparatus 130 becomes out of plumb, because of the geometric arrangement of the roller assemblies 144 relative to the centerline 190 of the door 102, various portions of the roller assemblies 144, including the inner steering shafts 174 will become displaced relative to the frame member 142, thereby causing the sensors 146 to generate new signals. Thus, for example, one wheel 156A and associated inner support member 166A may become generally displaced away from the frame member 142 while the other wheel 156B and associated inner support member 166B may become displaced generally toward the frame member 142 as shown in FIG. 5B. In such an instance, the first sensor 146A may generate a signal that is less than 2.5 volts while the second sensor 146B may generate a signal which is greater than 2.5 volts (or vice versa). The control module 148 then attempts to rectify the difference in voltage signals produced by the sensors 178A, 178B by activating the steering actuator 150 to turn the roller assemblies 144 in the appropriate direction such as is indicated in FIG. 2B, for example. As the sensors 146 provide new signals to the control module 148, the roller assemblies 144 may be further adjusted. When the sensors 146 generate voltage signals that are substantially equivalent, the control module 148 may direct the steering actuator 150 to turn the roller assemblies 144 back to their original orientation so that the door 102 may continue along its intended course.

It is noted that if the door 102 becomes out of plumb in the direction that is opposite to that indicated in FIG. 5B, that a similar process will occur but with the roller assemblies 144 being turned in the opposite direction so as to steer the door 102 back into a plumb orientation. Furthermore, the control module 148 is configured to note the direction in which the door 102 is traveling (i.e., opening or closing) and to factor this information into the determination of which way to turn the roller assemblies 144 in correcting a vertical deviation of the door 102. Additionally, it is contemplated that the position of the door 102 may be considered by the control module 148 such that, for example, if the door 102 is intended to travel through a curved path, the roller assemblies 144 assist in the door 102 turning and traversing such a path while also maintaining the plumb orientation of the door 102.

Figure 6:
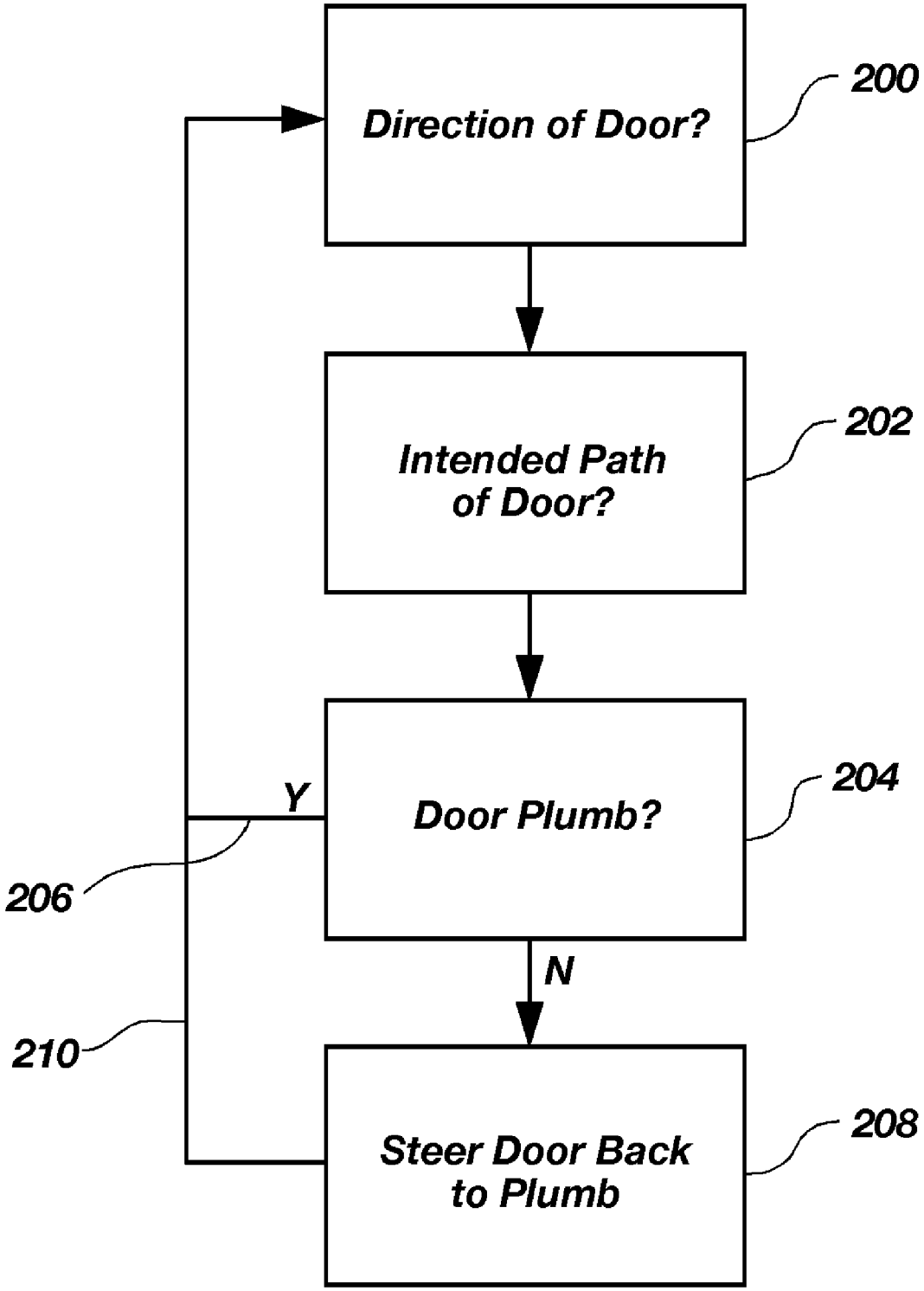
FIG. 6 is a flow chart depicting a method of controlling a movable partition in accordance with an embodiment of the present invention.

Thus, referring to FIG. 6, a method of operating a door 102 (FIG. 1) or other movable partition may include determining the direction of the door 102 (i.e., forward or reverse) as indicated at 200, and determining the intended pathway of the door 102 (e.g., whether the intended pathway is straight or curved) as indicated at 202. The method further includes determining whether the door 102, or a section thereof, is substantially plumb as indicated at 204. If the door 102, or section thereof, is plumb, the monitoring process continues as indicated at 206. If the door 102, or section thereof, is out of plumb, the door 102 may be steered or otherwise manipulated back to a plumb orientation without the need to stop or otherwise interrupt the operation of the door 102 as indicated at 208. The process then continues as indicated at 210.

Referring briefly to FIGS. 1A-1C, 2A and 2B, in another method, the directional control apparatus 130 need not be used for correcting out of plumb orientations of the door 102 or other movable partition. Rather, the directional control apparatus 130 may be used to assist in steering the movable partition through a curve or bend of a defined pathway. Thus, for example, the location of a particular section (such as the lead post 116) of the door 102 along the defined pathway may be determined. In one embodiment, an optical encoder may be utilized in conjunction with the drive of the door 102 to determine the location of the leading edge of the door 102 (or some other section) along the defined pathway. As a particular section of the door 102 traverses the bend in the pathway, the directional control apparatus 130 may selectively steer that section, or more particularly the lower edge of the movable partition associated with the section, through the curve or bend in the pathway.

Figure 7A:
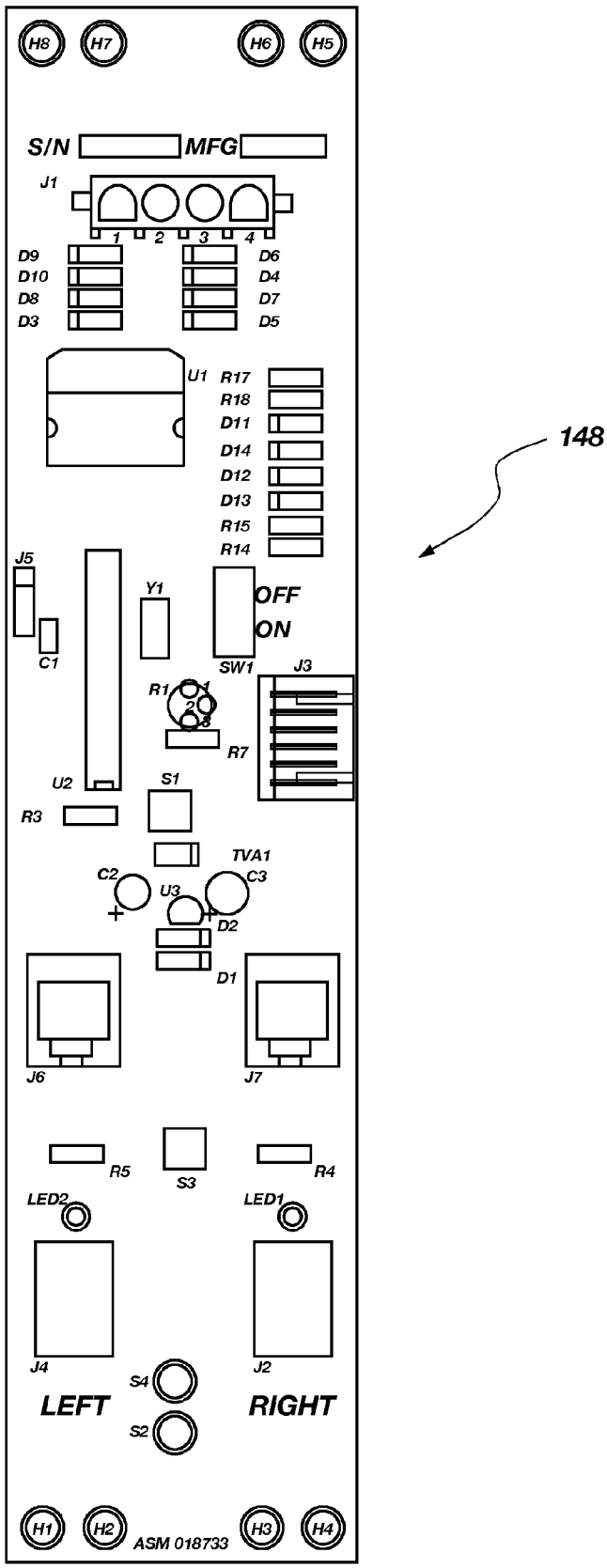
FIGS. 7A and 7B show an exemplary control module and control schematic that may be employed with the apparatus of FIGS. 2A and 2B.
Figure 7B:
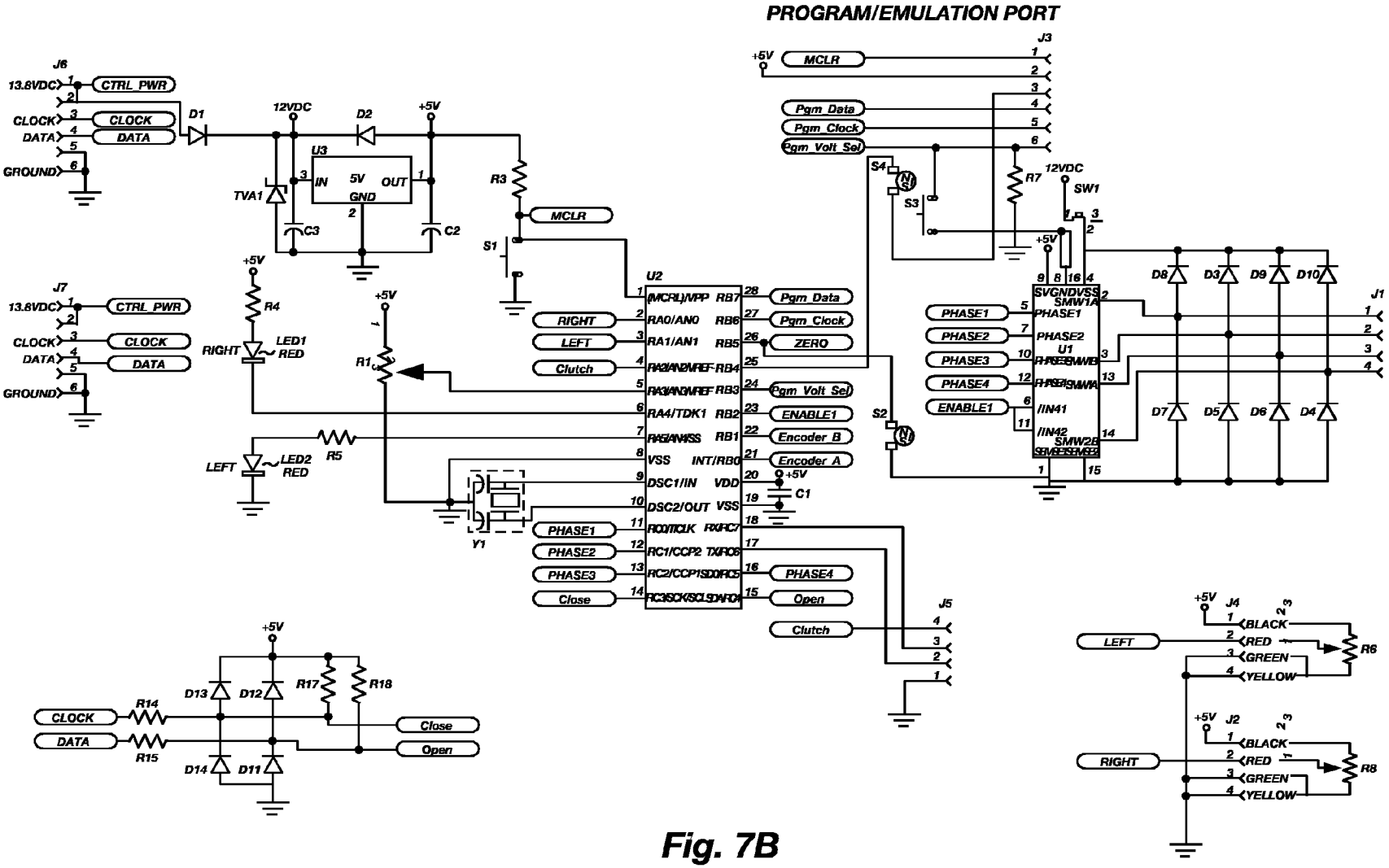

Referring now to FIG. 7A, an exemplary control module 148 is shown as a printed circuit board while an exemplary associated electrical schematic is shown in FIG. 7B. Such a control module 148 and associated electrical scheme may be used in conjunction with the control of the above-described directional control apparatus 130 and in carrying out the above-described method of controlling a door 102 or other movable partition. However, as will be appreciated by those of ordinary skill in the art, various control schemes and hardware/software implementations may be used in practicing the present invention. It is noted that the exemplary control module 148 or other component of the directional control apparatus 130 may be in communication with a system controller (not shown). Such a controller may include, for example, a processing unit, memory devices, input and output devices and be configured to monitor the state of the door 102 (e.g., position along a defined path, opening, closing, plumb, out of plumb, etc.), monitor other aspects related to the control of the door (e.g., whether a triggering event such as actuation of an alarm has occurred), and thereby operate the door under a defined set of parameters or rules.

Figure 8A:
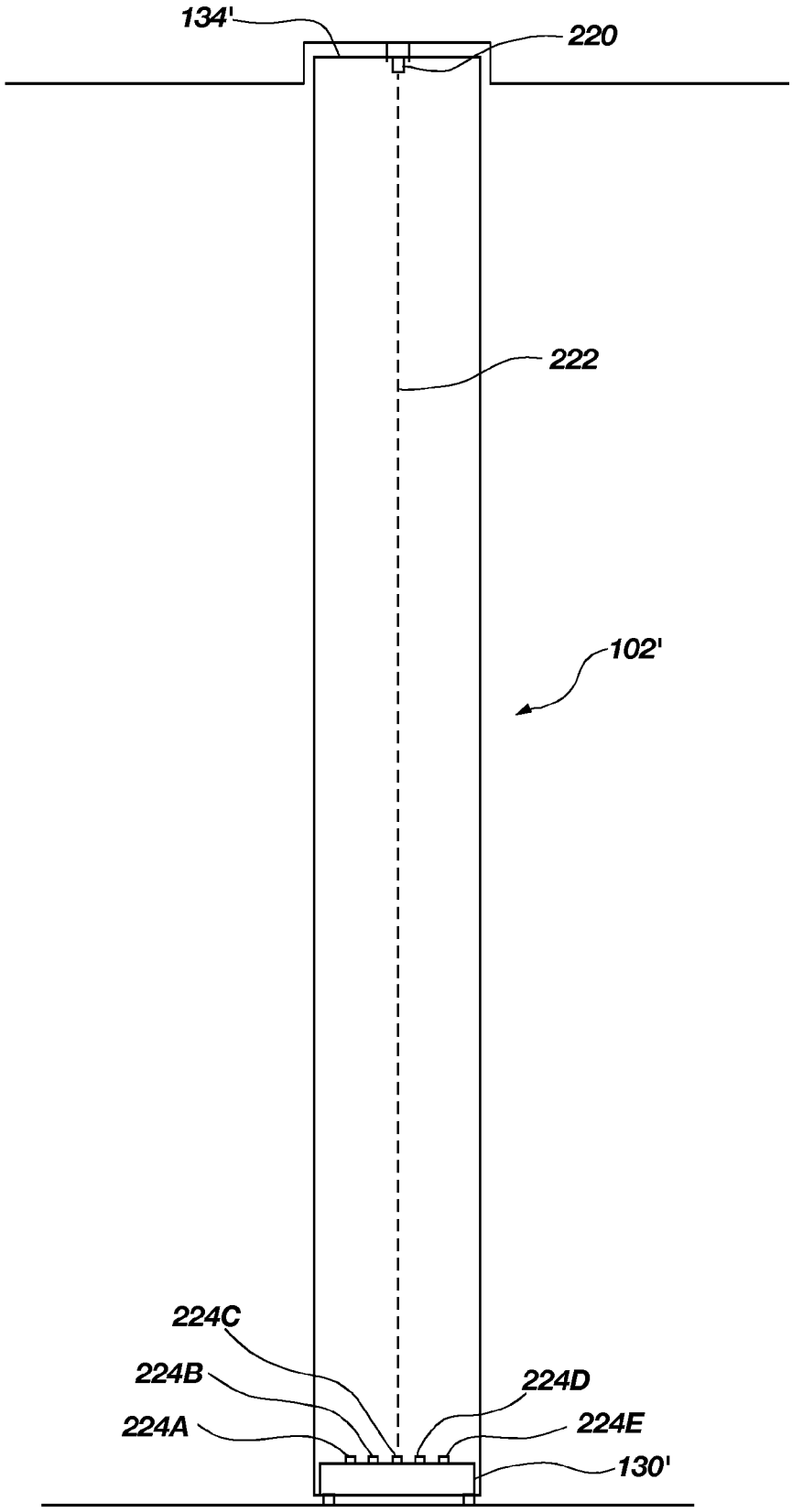
FIGS. 8A and 8B show schematic views of another apparatus for directionally controlling a movable partition in accordance with an embodiment of the present invention.
Figure 8B:
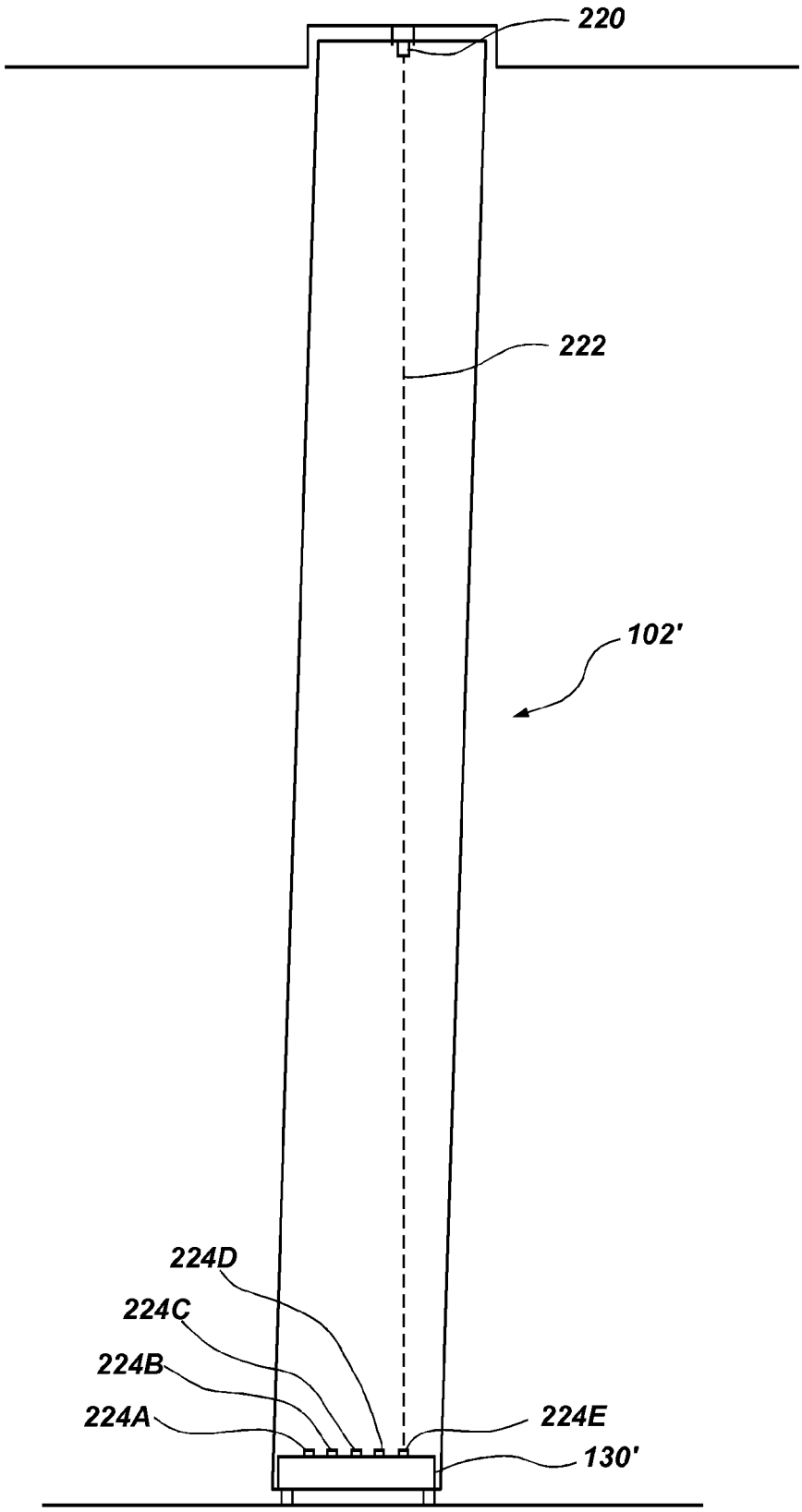

Referring now to FIGS. 8A and 8B, a schematic view of a movable partition, such as a door 102', in accordance with another embodiment of the present invention is shown. A signal transmitter 220 transmits a discrete signal 222, such as a laser beam, from a laterally fixed location adjacent the upper edge 134' of door 102'. The discrete signal 222 is detected by one or more of a plurality of discrete signal detectors or sensors 224A-224E such as, for example, photodiodes. The sensors 224A-224E may be substantially symmetrically laterally disposed with respect to the vertical centerline of the door 102' (i.e., when the door is plumb). In operation, the detection of the discrete signal 222 by one of the sensors 224A-224E determines whether or not the door 102' is plumb. Thus, for example, the detection of the discrete signal 222 by the center sensor 224C, as shown in FIG. 8A, may indicate that the door 102', or the section where the directional control apparatus 130' is located, is plumb. On the other hand, detection of the discrete signal 222 (which remains plumb regardless of the orientation of the door 102') by an off-center sensor such as, for example, sensor 224E, may indicate that the door 102' is out of plumb. The directional control apparatus 130' may then appropriately return the door 102' to a plumb orientation or state in a manner as described above.

It is noted that, while the exemplary embodiments described hereinabove include a pair of roller/steering elements (e.g., roller assemblies 144 and/or wheels 156), the present invention may be practiced with a single roller/steering element if so desired. However, it is also noted that in some embodiments, an arrangement using multiple roller/steering elements that are spaced about, or substantially symmetrically located relative to, the vertical centerline of the door (e.g., centerline 190 of FIGS. 5A and 5B) provides additional lateral support to the door 102, 102' such that a draft or application of a force to the door 102, 102' is less likely to cause the door 102, 102' to become out of plumb. For example, it has been determined that the embodiment shown and described with respect to FIGS. 2A, 2B and 3 provides improved lateral support such that an associated door 102 remained substantially plumb until a force of at least 40 pounds (lbs.) is applied at a location adjacent the lead post 116 (FIG. 1A) and approximately midway between the lower and upper edges 132 and 134 thereof.

Figure 9:
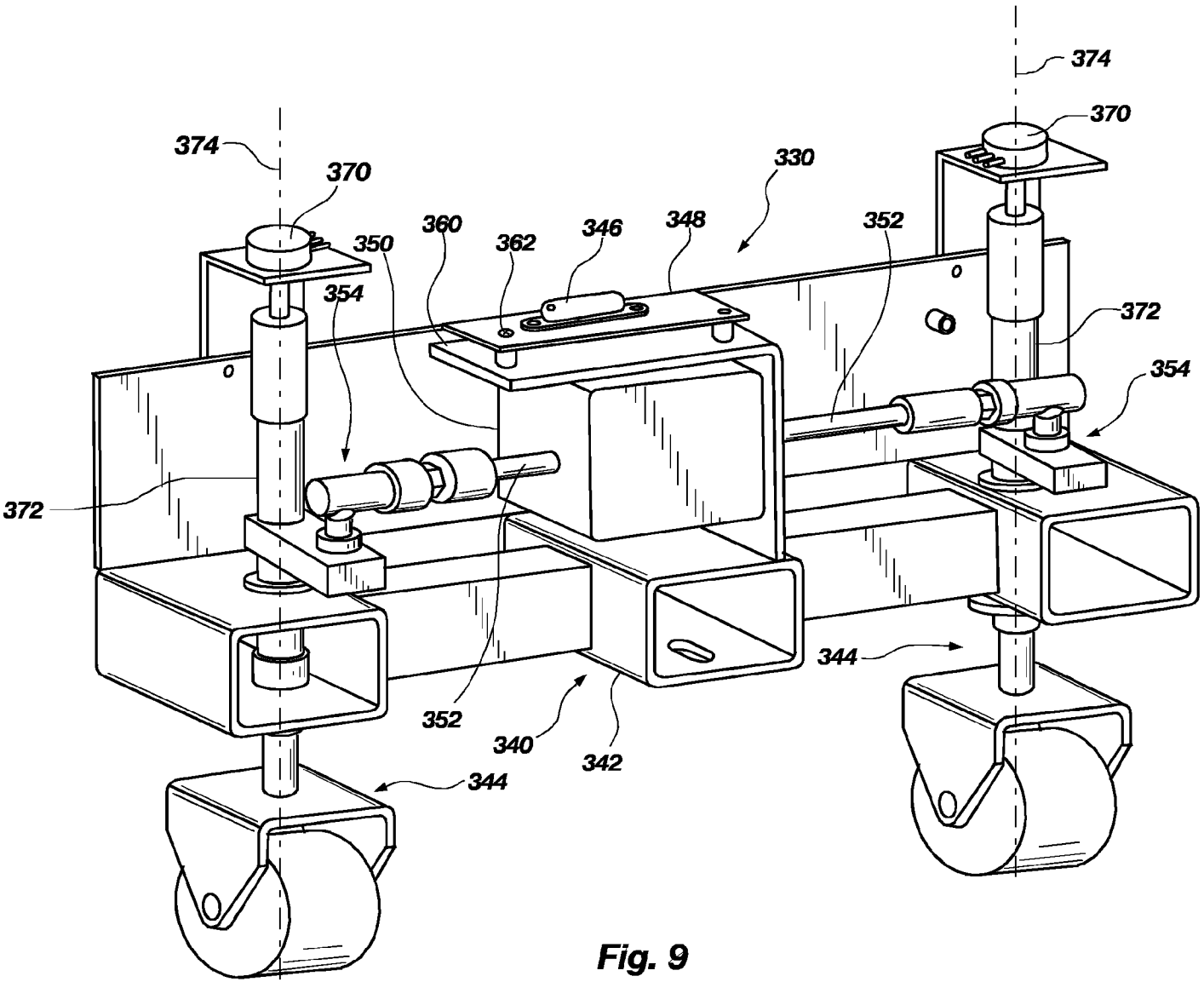
FIG. 9 is a perspective view of an apparatus for directionally controlling a movable partition in accordance with yet another embodiment of the present invention.

Referring now to FIG. 9, another exemplary directional control apparatus 330 includes a trolley 340 comprising a frame member 342 and one or more steerable roller assemblies 344 coupled therewith. The frame member 342 may also be configured to be coupled with a section of the door 102 (FIGS. 1A-1C), such as, for example, adjacent the lead post 116. One or more sensors 346 may be used to determine whether the door 102 (FIGS. 1A-1C), or at least the section in which the directional control apparatus 330 is disposed, is out of plumb. The sensor 346 may be operatively coupled to and in communication with a control module 348 that provides instructions to and controls a steering actuator 350. The steering actuator 350 may be mechanically coupled with the roller assemblies 344 through linkage components including, for example, drive rods 352 and ball and socket assemblies 354. In another embodiment, the steering actuator 350 may be more directly coupled to a roller assembly 344 such as through appropriate gearing or other appropriate mechanical couplings. The steering actuator 350 may include, for example, a linear positioning stepper motor configured to displace the drive rods 352 in a substantially linear direction. Of course, other actuators and drive assemblies may be utilized as will be appreciated by those of ordinary skill in the art.

In one exemplary embodiment, the sensor 346 may include a tilt sensor, such as an MCL NARROW ANGLE 0703 sensor available from The Fredricks Company of Huntingdon Valley, Pa. The sensor 346, as well as the control module 348, may be mounted on a bracket 360 and include an adjustment mechanism 362, such as a screw or other device, to help adjust the orientation of the sensor 346 relative to the bracket 360 and calibrate the sensor 346 to a true level orientation.

During operation of the directional control apparatus 330, if the section of the door 102 positioned above the directional control apparatus 330 becomes out of plumb, because of the geometric arrangement of the roller assemblies 344 relative to the centerline 190 of the door 102 (FIG. 1C), the tilt sensor 346 would become out of level and generate a representative signal of such a state or condition. Upon generation of such an out-of-level signal, the steering actuator 350 may displace the drive rods 352 and turn the roller assemblies 344 in an appropriate direction to steer the directional control apparatus 330 such that the portion of the door 102 to which it is attached becomes displaced back to a plumb condition such as has been described with respect to other embodiments disclosed herein.

Once the section of the door 102 returns to a plumb orientation, the sensor 346 will sense that it is back to a level state (commensurate with the in plumb orientation of the section of the door 102) and generate an appropriate signal such that the steering actuator 350 returns the roller assemblies 344 to a commensurate steering position. It is noted that the sensor 346 may be configured to produce a signal which corresponds with the out-of-plumb magnitude of the section of the door 102. In other words, if the section of the door 102 being monitored is only slightly out of plumb, then the roller assemblies 344 will only be adjusted a relatively small amount. On the other hand, if the section of the door 102 being monitored is grossly out of plumb, the roller assemblies 344 may experience a substantial displacement or reorientation in order to bring the section of the door 102 back into plumb more quickly and efficiently. Again, while the exemplary embodiment is described in terms of "plumb" and "out of plumb" the present invention may be used to detect an orientation of a section of the door 102 relative to plumb and reposition the section of the door, if necessary, to a specified orientation which may or may not be plumb.

In another embodiment, the relative position section of the door 102 along a defined pathway may be utilized to determine the magnitude of steering correction applied by the roller assemblies 344. In one example, the section of the door 102 being monitored may include the lead post 116 and the magnitude of steering correction to be provided by the roller assemblies 344 in order to bring the lead post 116 back to a plumb state may vary depending on the distance remaining between the lead post 116 and the structure with which it will eventually engage (e.g., the door post 118 of FIG. 1B). Thus, if a relatively short distance remains between the lead post 116 and the door post 118 with which it will engage, more aggressive steering correction may be needed to ensure that the lead post 116 returns to plumb before it reaches the door post 118.

To assist in determining and controlling the magnitude of steering correction being applied by the roller assemblies 344, a rotational potentiometer or other sensor 370 may be coupled to a shaft 372 or other component of the roller assemblies 344 to determine the radial orientation of the roller assemblies 344 relative to an axis 374 about which such assemblies rotate. The information regarding the radial orientation, as determined by the potentiometer or other sensor 370, may be used to determine whether applied steering correction is adequate for a given scenario, or whether additional steering correction is required.

In yet another embodiment, multiple sensors 346 may be used such that, for example, one sensor 346 may be utilized in detecting the orientation of the door 102 (or section thereof) while it is being displaced in a first direction, (e.g., while deploying the door 102) and a second sensor 346 may be utilized in detecting the orientation of the door 102 while it is being displaced in a second direction (e.g., while the door is being opened or retracted). In one exemplary embodiment, a specified section of the door 102 may need to be placed in a first specific orientation while in a deployed state but in a second specified orientation, different from the first, while in a retracted state.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention includes all modifications, equivalents, and alternatives falling within the spirit and scope of the invention as defined by the following appended claims.

What is claimed is:

1. A trolley for supporting a movable partition, the trolley comprising:

a frame member configured to be coupled to a lower edge of a movable partition for dividing an area of space within a building;

at least one roller assembly coupled with the frame member and comprising at least one roller element;

a steering actuator operatively coupled with the at least one roller assembly and configured to alter an orientation of the at least one roller assembly relative to the frame member and steer a lead post of a movable partition to be coupled to the frame member into alignment with a doorpost, at least one sensor located and configured to determine an orientation relative to vertical of at least a portion of the movable partition and generate a signal representative of the orientation; and a controller configured to receive the signal from the at least one sensor and to selectively control operation of the steering actuator in response to the signal from the at least one sensor.

2. The trolley of claim 1, wherein the at least one roller assembly further comprises at least two roller assemblies coupled with the frame member so as to be disposed substantially symmetrically about a vertical centerline of the movable partition.

3. The trolley of claim 1, wherein the at least one sensor comprises at least one photodiode.

4. The trolley of claim 3, wherein the at least one photodiode comprises a plurality of photodiodes disposed substantially laterally symmetrically about a vertical centerline of the movable partition.

5. The trolley of claim 2 further comprising:

an alignment apparatus including at least one alignment sensor, the at least one alignment sensor located and configured to determine when the at least one roller assembly is at a desired orientation with respect to the frame member.

6. The trolley of claim 5, wherein the at least one alignment sensor includes at least one magnetic proximity switch and wherein the alignment apparatus further comprises an alignment indicator formed of a ferromagnetic material and coupled with the at least one roller assembly adjacent the at least one magnetic proximity switch.

7. A trolley for supporting a movable partition, the trolley comprising:

a frame member configured to be coupled to a lower edge of a movable partition;

at least two roller assemblies coupled with the frame member so as to be disposed substantially symmetrically about a vertical centerline of the movable partition, each roller assembly of the at least two roller assemblies comprising at least one roller element;

a steering actuator operatively coupled with the at least two roller assemblies and configured to alter orientations of the at least two roller assemblies relative to the frame member;

at least one sensor located and configured to determine an orientation relative to vertical of at least a portion of the movable partition and generate a signal representative of the orientation; and a controller configured to receive the signal from the at least one sensor and to selectively control operation of the steering actuator in response to the signal from the at least one sensor;

wherein the at least one roller element of each of the at least two roller assemblies is displaceable along a defined axis relative to the frame member, and wherein each of the at least two roller assemblies further comprises a biasing element configured to bias each of the at least two roller elements thereof away from the frame member along the defined axis.

8. The trolley of claim 7, wherein each of the at least two roller assemblies further comprises:

a first support member having a shaft coupled therewith and oriented along the defined axis; and a second support member having a shaft coupled therewith and oriented along the defined axis and wherein the shaft of the second support member is disposed within, and displaceable relative to, a channel formed in the shaft of the first support member; and wherein the at least one sensor is located and configured to detect a position of the shaft of the second support member along the defined axis relative to the frame member.

9. A method of closing a partition, comprising:

sensing an orientation of at least a portion of the partition with at least one sensor as the partition is moving along a pathway; and adjusting the orientation of the at least a portion of the partition in response to a signal generated by the at least one sensor, adjusting the orientation comprising using a steering device to change an orientation of at least one roller assembly of a trolley coupled to a lower edge of the partition.

10. The method of claim 9, wherein adjusting the orientation of the at least a portion of the partition comprises maintaining the partition at least substantially plumb.

11. The method of claim 9, further comprising carrying the at least one sensor on the trolley.

12. A partition system, comprising:

at least one movable partition configured to divide an area of space within a building, the at least one movable partition comprising a plurality of hingedly coupled panels;

a drive device for driving movement of the at least one partition; and a trolley comprising:

a frame coupled to a lower edge of the at least one movable partition;

at least one roller assembly coupled to the at least one movable partition; and a steering device coupled to the at least one roller assembly for steering the movable partition along a pathway as the drive device drives movement of the at least one movable partition.

* * * * *